United States Patent [19]

Masumoto et al.

[11] Patent Number: 5,053,084

[45] Date of Patent: Oct. 1, 1991

[54] HIGH STRENGTH, HEAT RESISTANT ALUMINUM ALLOYS AND METHOD OF PREPARING WROUGHT ARTICLE THEREFROM

[75] Inventors: Tsuyoshi Masumoto, 3-8-22, Kamisugi, Sendai-shi, Miyagi; Akihisa Inoue, Sendai; Katsumasa Odera, Kurobe; Masahiro Oguchi, Okaya, all of Japan

[73] Assignees: Yoshida Kogyo K. K.; Tsuyoshi Masumoto, Tokyo, Japan; a part interest

[21] Appl. No.: 515,334

[22] Filed: Apr. 30, 1990

Related U.S. Application Data

[63] Continuation of Ser. No. 230,427, Aug. 10, 1988, abandoned.

[30] Foreign Application Priority Data

Aug. 12, 1987 [JP] Japan ..... 62-199971

[51] Int. Cl.[5] ..... C22C 21/00

[52] U.S. Cl. ..... 148/11.5 A; 72/364; 148/403; 148/415; 148/416; 148/437; 148/438; 420/902

[58] Field of Search ..... 148/403, 415, 416, 437, 148/438, 11.5 A; 420/902; 72/364

[56] References Cited

U.S. PATENT DOCUMENTS 4,715,893 12/1987 Skinner et al. ..... 148/403

OTHER PUBLICATIONS

Inoue et al. (I), "New Amorphous Alloys with Good Ductility in Al-Y-M and Al-La-M (m=Fe, Co, Ni or Cu) Systems", Japanese Journal of Applied Physics, vol. 27, No. 3, Mar. 1988, pp. L280-L282.

Inoue et al. (II), "Aluminum-Based Amorphous Alloys with Tensile Strength above 980 MPa (100 kg/mm$^2$)", Japanese Journal of Applied Physics, vol. 27, No. 4, Apr. 1988, pp. L479-L482.

*Primary Examiner*—R. Dean

*Assistant Examiner*—David W. Schumaker

*Attorney, Agent, or Firm*—Hill, Van Santen, Steadman & Simpson

[57] ABSTRACT

The present invention provides high-strength, heat resistant aluminum alloys having a composition represented by the general formula:

$$Al_aM_bX_d \text{ or } Al_aM_bQ_cX_e$$

(wherein M is at least one metal element selected from the group consisting of Cu, Ni, Co and Fe; Q is at least one metal element selected from the group consisting Mn, Cr, Mo, W, V, Ti and Zr; X is at least one metal element selected from the group consisting of Nb, Ta, Hf and Y; and a, b, c, d and e are atomic percentages falling within the following ranges: $45 \leqq a \leqq 90$, $5 \leqq b \leqq 40$, $0 < c \leqq 12$, $0.5 \leqq d \leqq 15$ and $0.5 \leqq e \leqq 10$, the aluminum alloy containing at least 50% by volume of amorphous phase. The aluminum alloys are especially useful as high strength, high heat resistant materials in various applications and since they exhibit a superplasticity in the vicinity of their crystallization temperature, they provide high-strength and heat resistant wrought materials by extrusion, pressing or hot-forging at the temperatures within the range of the crystallization temperature±100° C.

6 Claims, 3 Drawing Sheets

HIGH STRENGTH, HEAT RESISTANT ALUMINUM ALLOYS AND METHOD OF PREPARING WROUGHT ARTICLE THEREFROM

This is a continuation of application Ser. No. 07/230,427 filed Aug. 10, 1988, now abandoned.

BACKGROUND OF THE INVENTION

1. Field of the Invention

The present invention relates to aluminum alloys having a desired combination of properties of high hardness, high strength, high wear-resistance and superior heat-resistance and to a method for preparing wrought articles from such aluminum alloys by extrusion, press working or hot-forging.

2. Description of the Prior Art

As conventional aluminum alloys, there have been known various types of aluminum-based alloys such as Al-Cu, Al-Si, Al-Mg, Al-Cu-Si, Al-Zn-Mg alloys, etc. These aluminum alloys have been extensively used in a variety of applications, such as structural materials for aircrafts, cars, ships or the like; structural materials used in external portions of buildings, sash, roof, etc.; marine apparatus materials and nuclear reactor materials, etc., according to their properties.

In general, the aluminum alloys heretofore known have a low hardness and a low heat resistance. In recent years, attempts have been made to achieve a fine structure by rapidly solidifying aluminum alloys and thereby improve the mechanical properties, such as strength, and chemical properties, such as corrosion resistance, of the resulting aluminum alloys. But none of the rapid solidified aluminum alloys known heretofore has been satisfactory in the properties, especially with regard to strength and heat resistance.

SUMMARY OF THE INVENTION

In view of the foregoing, it is an object of the present invention to provide novel aluminum alloys which have a good combination of properties of high hardness, high strength and superior corrosion resistance.

An another object of the present invention is to provide novel high strength, heat resistant aluminum alloys which can be successfully subjected to operations such as extrusion, press working, hot-forging or a high degree of bending because of their good workability.

A further object of the invention is to provide a method for preparing wrought articles from the novel aluminum alloys specified above by extrusion, press working or hot-forging without deteriorating their properties.

According to the present invention, there are provided high-strength, heat resistant aluminum-based alloys having a composition represented by the following general formula (I) or (II) and the aluminum alloys contain at least 50% by volume of amorphous phase.

$$Al_aM_bX_d \quad (I)$$

$$Al_aM_bQ_cX_e \quad (II)$$

wherein:

M is at least one metal element selected from the group consisting of Cu, Ni, Co and Fe;

Q is at least one metal element selected from the group consisting Mn, Cr, Mo, W, V, Ti and Zr;

X is at least one metal element selected from the group consisting of Nb, Ta, Hf and Y; and a, b, c, d and e are atomic percentages falling within the following ranges: $45 \leqq a \leqq 90$, $5 \leqq b \leqq 40$, $0 < c \leqq 12$, $0.5 \leqq d \leqq 20$ and $0.5 \leqq e \leqq 10$.

The aluminum alloys of the present invention are very useful as high-hardness material, high-strength material, high electrical-resistant material, wear-resistant material and brazing material.

Further, since the aluminum alloys specified above exhibit a superplasticity in the vicinity of their crystallization temperature, they can be readily processed into bulk by extrusion, press working or hot forging at the temperatures within the range of the crystallization temperature ±100° C. The wrought articles thus obtained can used as high strength, high heat-resistant material in many practical applications because of their high hardness and high tensile strength. The present invention also provides a method for preparing such wrought articles by extrusion, press working or hot-forging.

DETAILED DESCRIPTION OF THE PREFERRED EMBODIMENTS

Figure 1:
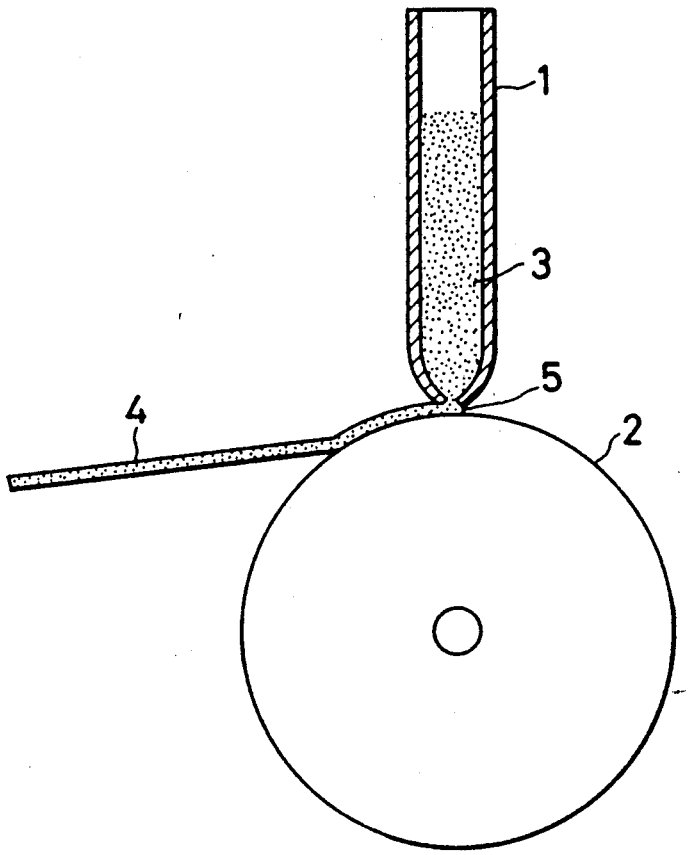
FIG. 1 is a schematic view of a single roller-melting apparatus employed to prepare ribbons from the alloys of the present invention by a rapid solidification process.

The aluminum alloys of the present invention can be obtained by rapidly solidifying melt of the alloy having the composition as specified above by means of a liquid quenching technique. The liquid quenching technique is a method for rapidly cooling molten alloy and, particularly, single-roller melt-spinning technique, twin roller melt-spinning technique and in-rotating-water melt-spinning technique are mentioned as effective examples of such a technique. In these techniques, the cooling rate of about $10^4$ to $10^6$ K/sec can be obtained. In order to produce ribbon materials by the single-roller melt-spinning technique or twin roller melt-spinning technique, molten alloy is ejected from the opening of a nozzle to a roll of, for example, copper or steel, with a diameter of about 30–3000 mm, which is rotating at a constant rate of about 300–10,000 rpm. In these techniques, various ribbon materials with a width of about 1–300 mm and a thickness of about 5–500 μm can be readily obtained. Alternatively, in order to produce wire materials by the in-rotating-water melt-spinning technique, a jet of molten alloy is directed , under application of the back pressure of argon gas, through a nozzle into a liquid refrigerant layer with a depth of about 1 to 10 cm which is formed by centrifugal force in a drum rotating at a rate of about 50 to 500 rpm. In such a manner, fine wire materials can be readily obtained. In this technique, the angle between the molten alloy ejecting from the nozzle and the liquid refrigerant surface is preferably in the range of about 60° to 90° and the ratio of the velocity of the ejected molten alloy to the velocity of the liquid refrigerant is preferably in the range of about 0.7 to 0.9.

Besides the above process, the alloy of the present invention can be also obtained in the form of thin film by a sputtering process. Further, rapidly solidified powder of the alloy composition of the present invention can be obtained by various atomizing processes, for example, high pressure gas atomizing process or spray process.

Whether the rapidly solidified alloys thus obtained above are amorphous or not can be known by checking the presence of the characteristic halo pattern of an amorphous structure using an ordinary X-ray diffraction method. The amorphous structure is transformed into a crystalline structure by heating to a certain temperature (called "crystallization temperature") or higher temperatures.

In the aluminum alloys of the present invention represented by the general formula (I), a is limited to the range of 45 to 90 atomic % and b is limited to the range of 5 to 40 atomic %. The reason for such limitations is that when a and b stray from the respective ranges, it is difficult to form an amorphous region in the resulting alloys and the intended alloys having at least 50 volume % of amorphous region can not be obtained by industrial cooling techniques using the above-mentioned liquid quenching, etc. The reason why d is limited to the range of 0.5 to 20 atomic % is that when the elements represented by X (i.e., Nb, Ta, Hf and Y) are added singly or in combination of two or more thereof in the specified range, considerably improved hardness and heat resistance can be achieved. When d is beyond 20 atomic %, it is impossible to obtain alloys having at least 50 volume % of amorphous phase.

In the aluminum alloys of the present invention represented by the general formula (II), a is limited to the range of 45 to 90 atomic % and b is limited to the range of 5 to 40 atomic %. The reason for such limitations is that when a and b stray from the respective ranges, it is difficult to develop an amorphous region in the resulting alloys and the intended alloys having at least 50 volume % of amorphous region can not be obtained by industrial cooling techniques using the above-mentioned liquid quenching, etc. The reason why c and e are limited to the range of not more than 12 atomic % and the range of 0.5 to 10 atomic %, respectively, is that at least one metal element Q selected from the group consisting of Mn, Cr, Mo, W, V, Ti and Zr and at least one metal element X selected from the group consisting of Nb, Ta, Hf and Y remarkedly improve the hardness and heat resistance properties of the alloys in combination thereof.

The reason why the upper limits of c and e are 12 atomic % and 10 atomic %, respectively, is that addition of Q and X exceeding the respective upper limits make impossible the attainment of the alloys containing at least 50% by volume of amorphous region.

Further, since the aluminum alloys of the present invention exhibit superplasticity in the vicinity of their crystallization temperatures (crystallization temperature ±100° C.), they can be readily subjected to extrusion, press working, hot forging, etc. Therefore, the aluminum alloys of the present invention obtained in the form of ribbon, wire, sheet or powder can be successfully processed into bulk by way of extrusion, pressing, hot forging, etc., at the temperature range of their crystallization temperature ±100° C. Further, since the aluminum alloys of the present invention have a high degree of toughness, some of them can be bent by 180° without fracture.

As set forth above, the aluminum alloys of the present invention have the foregoing two types of compositions, namely, aluminum-based composition with addition of the element M ( one or more elements of Cu, Ni, Co and Fe) and the element X (one or more elements of Nb, Ta, Hf and Y) and aluminum-based composition with addition of the element M, the element X and the element Q (one or more elements of Mn, Cr, Mo, W, V, Ti and Zr). In the alloys, the element M has an effect in improving the capability to form an amorphous structure. The elements Q and X not only provide significant improvements in the hardness and strength without deteriorating the capability to form an amorphous structure, but also considerably increase the crystallization temperature, thereby resulting in a significantly improved heat resistance.

Now, the advantageous features of the aluminum alloys of the present invention will be described with reference to the following examples.

EXAMPLE 1

Molten alloy 3 having a predetermined alloy composition was prepared by high-frequency melting process and was charged into a quartz tube 1 having a small opening 5 with a diameter of 0.5 mm at the tip thereof, as shown in FIG. 1. After heating and melting the alloy 3, the quartz tube 1 was disposed right above a copper roll 2, 20 cm in diameter. Then, the molten alloy 3 contained in the quartz tube 1 was ejected from the small opening 5 of the quartz tube 1 under the application of an argon gas pressure of 0.7 kg/cm$^2$ and brought into contact with the surface of the roll 2 rapidly rotating at a rate of 5,000 rpm. The molten alloy 3 is rapidly solidified and an alloy ribbon 4 was obtained.

According to the processing conditions as described above, 51 different kinds of alloys having the compositions given in Table 1 were obtained in a ribbon form, 1 mm in width and 20 μm in thickness, and were subjected to X-ray diffraction analysis. In all of the alloys halo patterns characteristic of amorphous metal were confirmed.

Further, the hardness (Hv), electrical resistance ($\rho$) and crystallization temperature (Tx) were measured for each test specimen of the alloy ribbons and there were obtained the results as shown in Table 1. The hardness (Hv) is indicated by values (DPN) measured using a Vickers microhardness tester under load of 25 g. The electrical resistance ($\rho$) is values (μΩ.cm) measured by a conventional four-probe technique. The crystallization temperature ($T_x$) is the starting temperature (K) of the first exothermic peak on the differential scanning calorimetric curve which was conducted for each test specimen at a heating rate of 40 K/min. In the column of "Structure", characters "a" and "c" represent an amorphous structure and a crystalline structure, respectively, and subscripts of the character "c" show volume percentages of "c".

TABLE 1

| No. | Composition (by at. %) | Structure | Hv (DPN) | $\rho$ (μΩ · cm) | Tx (K) |
|---|---|---|---|---|---|
| 1. | $Al_{70}Fe_{20}Nb_{10}$ | a | 750 | 460 | 788 |
| 2. | $Al_{70}Fe_{20}Hf_{10}$ | a | 900 | 570 | 827 |
| 3. | $Al_{70}Fe_{20}Ta_{10}$ | $a+c_{10}$ | 970 | 630 | 860 |

TABLE 1-continued

| No. | Composition (by at. %) | Structure | Hv (DPN) | ρ (μΩ · cm) | Tx (K) |
|---|---|---|---|---|---|
| 4. | $Al_{70}Fe_{20}Y_{10}$ | a+$c_{30}$ | 990 | 670 | 875 |
| 5. | $Al_{70}Co_{20}Ta_{10}$ | a | 880 | 620 | 780 |
| 6. | $Al_{70}Co_{20}Nb_{10}$ | a | 740 | 580 | 760 |
| 7. | $Al_{70}Co_{20}Hf_{10}$ | a | 850 | 530 | 758 |
| 8. | $Al_{70}Co_{20}Y_{10}$ | a | 720 | 590 | 720 |
| 9. | $Al_{85}Ni_{10}Nb_5$ | a | 550 | 560 | 607 |
| 10. | $Al_{70}Ni_{20}Nb_{10}$ | a | 590 | 720 | 755 |
| 11. | $Al_{85}Ni_{10}Hf_5$ | a | 540 | 550 | 612 |
| 12. | $Al_{70}Ni_{20}Hf_{10}$ | a | 810 | 470 | 755 |
| 13. | $Al_{75}Ni_{20}Y_5$ | a | 520 | 520 | 590 |
| 14. | $Al_{70}Ni_{20}Y_{10}$ | a | 620 | 560 | 685 |
| 15. | $Al_{70}Ni_{20}Ta_{10}$ | a | 1040 | 710 | 820 |
| 16. | $Al_{70}Cu_{20}Hf_{10}$ | a | 630 | 520 | 623 |
| 17. | $Al_{70}Cu_{20}Ta_{10}$ | a | 975 | 690 | 768 |
| 18. | $Al_{70}Cu_{20}Nb_{10}$ | a | 855 | 590 | 692 |
| 19. | $Al_{70}Cu_{20}Y_{10}$ | a+$c_{10}$ | 860 | 595 | 688 |
| 20. | $Al_{70}Ni_{20}Cr_8Hf_2$ | a | 820 | 550 | 663 |
| 21. | $Al_{70}Ni_{20}Mo_8Hf_2$ | a | 850 | 630 | 755 |
| 22. | $Al_{70}Ni_{20}W_8Hf_2$ | a | 880 | 550 | 821 |
| 23. | $Al_{70}Cu_{20}Ti_8Hf_2$ | a | 870 | 480 | 660 |
| 24. | $Al_{70}Cu_{20}Zr_8Hf_2$ | a | 670 | 520 | 650 |
| 25. | $Al_{85}Cu_5V_8Nb_2$ | a | 540 | 470 | 605 |
| 26. | $Al_{75}Cu_{15}V_8Nb_2$ | a | 700 | 560 | 719 |
| 27. | $Al_{65}Cu_{25}V_8Nb_2$ | a | 1000 | 450 | 705 |
| 28. | $Al_{60}Cu_{30}V_8Nb_2$ | a | 1040 | 460 | 642 |
| 29. | $Al_{75}Cu_{15}V_5Y_5$ | a | 620 | 510 | 705 |
| 30. | $Al_{70}Cu_{15}V_{10}Y_5$ | a+$c_{10}$ | 870 | 570 | 773 |
| 31. | $Al_{70}Cu_{20}Cr_8Ta_2$ | a | 885 | 715 | 626 |
| 32. | $Al_{70}Cu_{20}Mo_8Ta_2$ | a | 810 | 700 | 715 |
| 33. | $Al_{70}Cu_{20}Mn_8Ta_2$ | a | 615 | 490 | 642 |
| 34. | $Al_{70}Ni_{20}Mn_8Hf_2$ | a | 705 | 512 | 701 |
| 35. | $Al_{65}Ni_{20}Cr_5Mo_5Hf_5$ | a | 730 | 540 | 723 |
| 36. | $Al_{65}Ni_{20}Zr_5Nb_5Hf_5$ | a+$c_{20}$ | 825 | 610 | 796 |
| 37. | $Al_{85}Co_5Zr_5Nb_5$ | a | 428 | 530 | 654 |
| 38. | $Al_{84}Co_5Cr_3Y_8$ | a | 422 | 550 | 640 |
| 39. | $Al_{75}Fe_{10}Mo_5Hf_{10}$ | a | 778 | 630 | 720 |
| 40. | $Al_{84}Fe_5Cr_3Y_8$ | a | 450 | 560 | 670 |
| 41. | $Al_{70}Ni_{15}Fe_5Hf_{10}$ | a | 860 | 510 | 786 |
| 42. | $Al_{70}Ni_{15}Co_5Y_{10}$ | a | 820 | 490 | 755 |
| 43. | $AL_{80}Fe_5Co_5Hf_5$ | a | 680 | 460 | 620 |
| 44. | $Al_{80}Cu_5Co_5Nb_{10}$ | a | 880 | 630 | 770 |
| 45. | $Al_{70}Ni_{10}Ti_{10}Hf_{10}$ | a | 850 | 550 | 635 |
| 46. | $Al_{80}Fe_5W_5Y_{10}$ | a | 920 | 625 | 830 |
| 47. | $AL_{70}Ni_{15}Co_5Mo_5Ta_5$ | a | 860 | 635 | 785 |
| 48. | $Al_{70}Ni_{10}Nb_{10}Y_{10}$ | a | 780 | 730 | 810 |
| 49. | $Al_{70}Ni_{10}Hf_{10}Y_{10}$ | a | 730 | 680 | 725 |
| 50. | $Al_{80}Fe_5Nb_5Y_{10}$ | a | 750 | 530 | 710 |
| 51. | $Al_{80}Ni_5Zr_5Hf_5Y_5$ | a | 720 | 620 | 730 |

As shown in Table 1, the aluminum alloys of the present invention have an extremely high hardness of the order of about 450 to 1050 DPN, in comparison with the hardness of the order of 50 to 100 DPN of ordinary aluminum-based alloys. Further, with respect to the electrical resistance, ordinary aluminum alloys have resistivity on the order of 100 to 300 μΩ.cm, while the amorphous aluminum alloys of the present invention have a high degree of resistivity of at least about 400 μΩ.cm. A further surprising effect is that the aluminum-based alloys of the present invention have very high crystallization temperatures Tx of at least 600 K and exhibit a greatly improved heat resistance.

The alloy No. 12 given in Table 1 was further examined for the strength using an Instron-type tensile testing machine. The tensile strength was about 95 kg/mm$^2$ and the yield strength was about 80 kg/mm$^2$. These values are 2.1 times of the maximum tensile strength (about 45 kg/mm$^2$) and maximum yield strength (about 40 kg/mm$^2$) of conventional age-hardened Al-Si-Fe aluminum alloys.

EXAMPLE 2

Master alloys $A_{70}Fe_{20}Hf_{10}$ and $Al_{70}Ni_{20}Hf_{10}$ were each melted in a vacuum high-frequency melting furnace and were formed into amorphous powder by high-pressure gas atomization process. The powder thus obtained from each alloy was sintered at a temperature of 100° to 550° C. for 30 minutes under pressure of 940 MPa to provide a cylindrical material with a diameter of 5 mm and a hight of 5 mm. Each cylindrical material was hot-pressed at a temperature of 400° C. near the crystallization temperature of each alloy for 30 minutes. The resulting hot-pressed sintered bodies had a density of about 95% of the theoretical density, hardness of about 850 DPN and electrical resistivity of 500 μΩ.cm. Further, the wear resistance of the hot-pressed bodies was approximately 100 times as high as that of conventional aluminum alloys.

EXAMPLE 3

Figure 2:
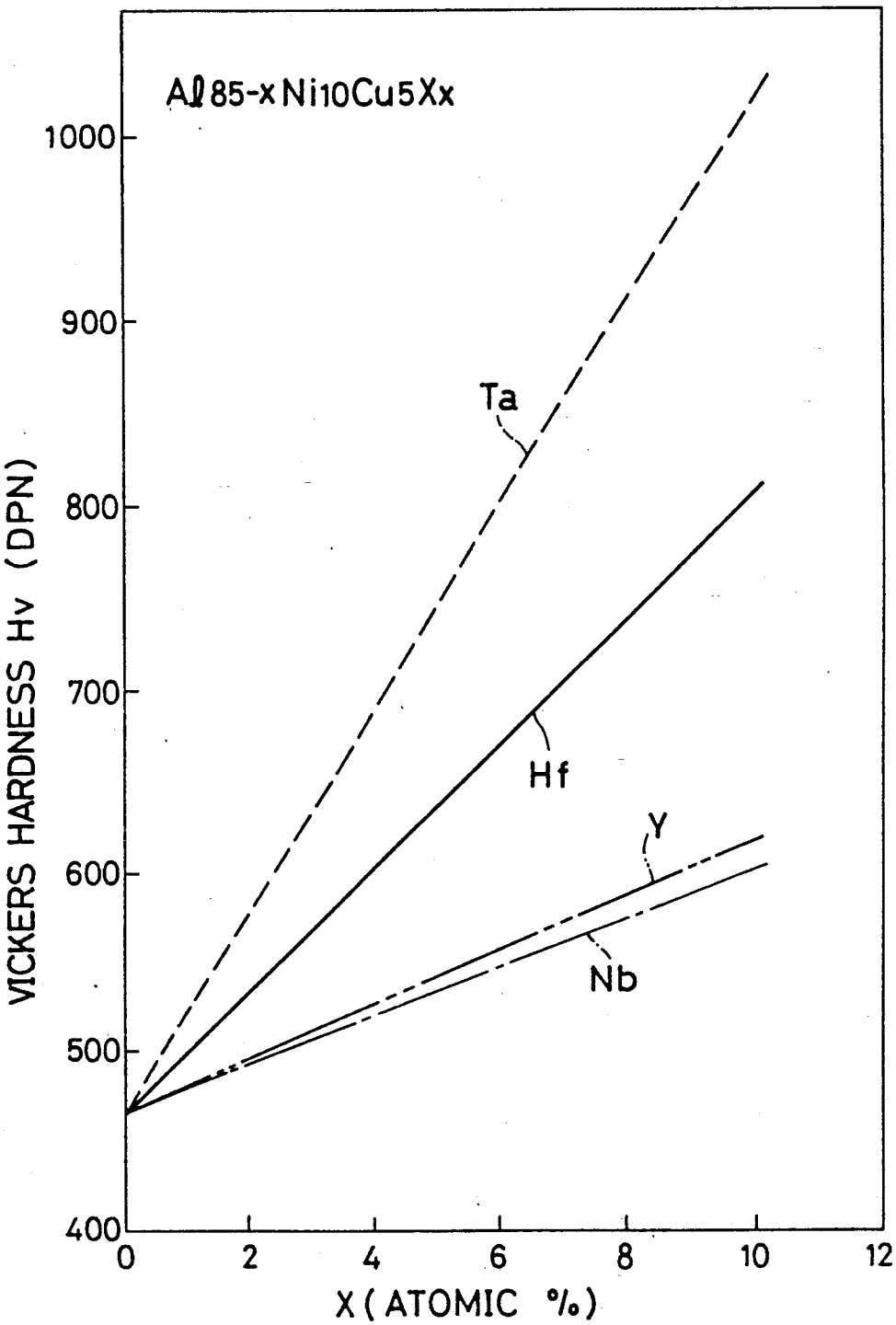
FIG. 2 is a graph showing the relationship between the Vickers hardness (Hv) and the content of the element X (X = Ta, Hf, Nb or Y) for the rapidly solidified ribbons of $Al_{85-x}Ni_{10}Cu_5X_x$ alloys according to the present invention.
Figure 3:
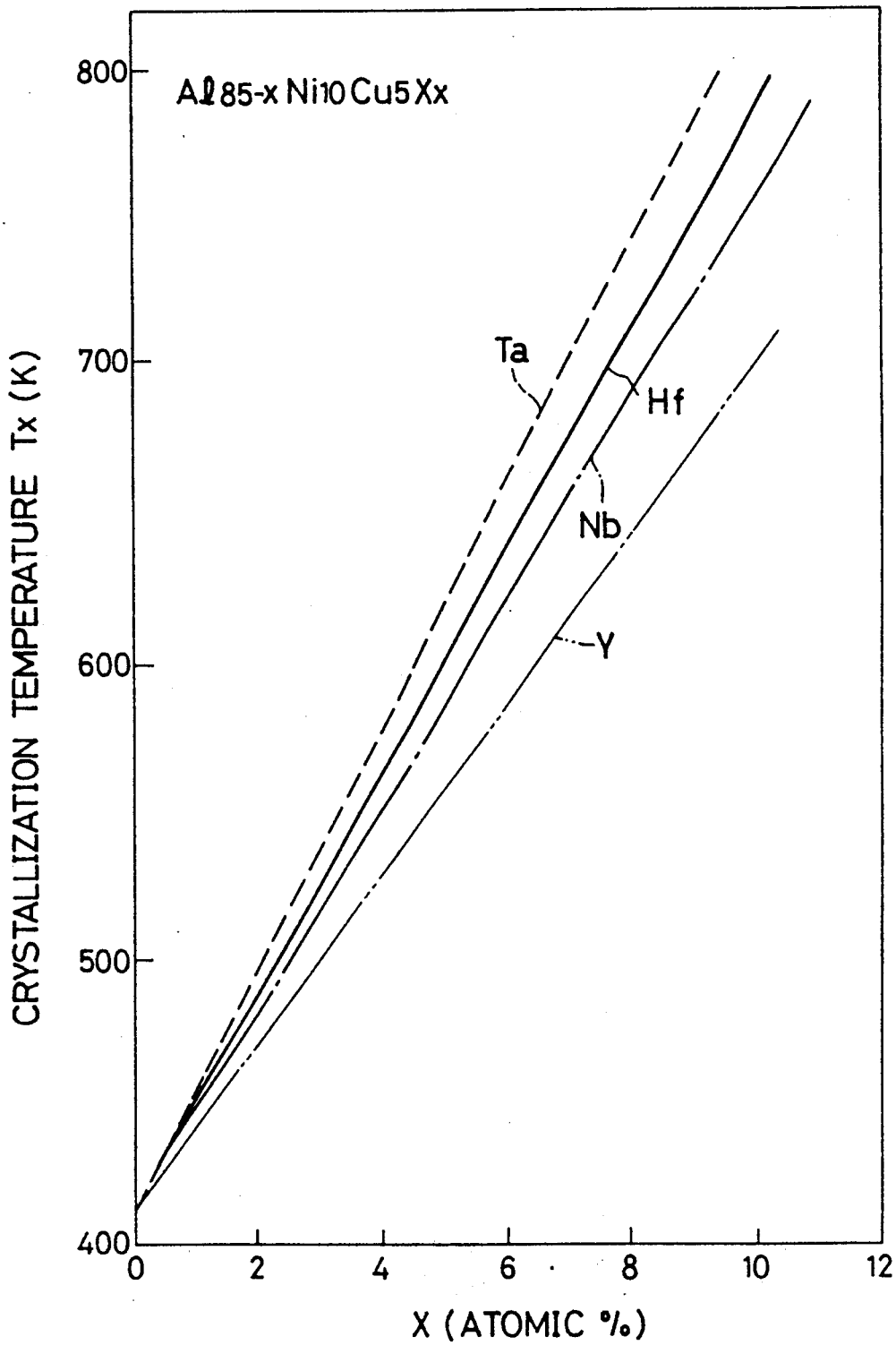
FIG. 3 is a graph showing the relationship between the crystallization temperature (Tx) and the content of the element X (X=Ta, Hf, Nb or Y) for the rapidly solidified ribbons of the $Al_{85-x}Ni_{10}Cu_5X_x$ alloys according to the present invention.

Alloy ribbons, 3 mm in width and 25 μm in thickness, were obtained from $Al_{85-x}Ni_{10}Cu_5X_x$ alloys within the compositional range of the present invention by the same rapid solidification process as described in Example 1. Hardness and crystallization temperature were measured for each test piece of the rapidly solidified ribbons. As the element X of the $Al_{85-x}Ni_{10}Cu_5X_x$ alloys, Ta, Hf, Nb or Y was chosen. The results of the measurements are summarized with the contents of the element X in FIGS. 2 and 3.

The $Al_{85}Ni_{10}Cu_5$ alloy had a structure mainly composed of crystalline. As apparent from the results shown in FIGS. 2 and 3, while the hardness and the crystallization temperature are only about 460 DPN and about 410 K, respectively, these values are markedly increased by addition of Ta, Hf, Nb or Y to the alloy and thereby high hardness and heat resistance can be obtained. Particularly, Ta and Hf have a prominent effect on these properties.

EXAMPLE 4

Alloy ribbons of $Al_{70}Cu_{20}Zr_8Hf_2$, $Al_{75}Cu_{20}Hf_5$, $Al_{75}Ni_{20}Ta_5$ alloys of the invention were each placed on $Al_2O_3$ and heated at 650° C. in a vacuum furnace to test wettability with $Al_2O_3$. The alloys all melted and exhibited good wettability. Using the above alloys, an $Al_2O_3$ sheet was bonded to an aluminum sheet. The two sheets could be strongly bound together and it has been found that the alloys of the present invention are also useful as brazing materials.

As described above, the aluminum alloys of the present invention are very useful as high-hardness material, high-strength material, high electrical-resistant material, wear-resistant material and brazing material. Further, the aluminum alloys can be easily subjected to extrusion, pressing, hot-forging because of their superior workability, thereby resulting in high strength and high heat-resistant bulk materials which are very useful in a variety of applications.

What is claimed is:

1. A high strength, heat resistant aluminum alloy having a composition represented by the general formula:

$$Al_aM_bX_d$$

wherein:

M is at least one metal element selected from the group consisting of Cu, Ni, Co and Fe;

X is at least one metal element selected from the group consisting of Nb, Ta, Hf and Y; and a, b and d are atomic percentages falling within the following ranges: $45 \leqq a \leqq 90$, $5 \leqq b \leqq 40$ and $0.5 \leqq d \leqq 20$, said aluminum alloy containing at least 50% by volume of amorphous phase.

2. A high strength, heat resistant aluminum alloy having a composition represented by the general formula:

$$Al_aM_bQ_cX_e$$

wherein:

M is at least one metal element selected from the group consisting of Cu, Ni, Co and Fe;

Q is at least one metal element selected from the group consisting Mn, Cr, Mo, W, V, Ti and Zr;

X is at least one metal element selected from the group consisting of Nb, Ta, Hf and Y; and a, b, c and e are atomic percentages falling within the following ranges: $45 \leqq a \leqq 90$, $5 \leqq b \leqq 40$, $0 < c \leqq 12$ and $2 \leqq e \leqq 10$, a said aluminum alloy containing at least 50% by volume of amorphous phase.

3. A method of preparing a wrought article from a high strength, heat resistant aluminum alloy by extrusion, press working or not-forging at temperatures within the range of the crystallization temperature of said aluminum alloy ±100° C., said aluminum alloy having a composition represented by the general formula:

$$Al_aM_bX_d$$

wherein:

M is at least one metal element selected from the group consisting of Cu, Ni, Co and Fe;

X is at least one metal element selected from the group consisting of Nb, Ta, Hf and Y;

and a, b and d are atomic percentages falling within the following ranges: $45 \leqq a \leqq 90$, $5 \leqq b \leqq 40$ and $0.5 \leqq d \leqq 20$, said aluminum alloy containing at least 50% by volume of amorphous phase.

4. A method of preparing a wrought article from a high strength, heat resistant aluminum alloy by extrusion, press working or hot-forging at temperatures within the range of the crystallization temperature of said aluminum alloy ±100° C., said aluminum alloy having a composition represented by the general formula:

$$Al_aM_bQ_cX_e$$

wherein:

M is at least one metal element selected from the group consisting of Cu, Ni, Co and Fe;

Q is at least one metal element selected from the group consisting Mn, Cr, Mo, W, V, Ti and Zr;

X is at least one metal element selected from the group consisting of Nb, Ta, Hf and Y; and a, b, c and e are atomic percentages falling within the following ranges: $45 \leqq a \leqq 90$, $5 \leqq b \leqq 40$, $0 < c \leqq 12$, and $2 \leqq e \leqq 10$, said aluminum alloy containing at least 50% by volume of amorphous phase.

5. A high strength, heat resistant aluminum alloy having a composition represented by the general formula:

$$Al_aM_bQ_cX_e$$

wherein:

M is at least one metal element selected from the group consisting of Cu, Ni, Co and Fe;

Q is at least one metal element selected from the group consisting of Mn, Cr, Mo, W, Ti and Zr;

X is at least one metal element selected from the group consisting of Nb, Ta, Hf and Y; and a, b, c and e are atomic percentages falling within the following ranges: $45 \leqq a \leqq 90$, $5 \leqq b \leqq 40$, $0 < c \leqq 12$ and $0.5 \leqq e \leqq 10$, said aluminum alloy containing at least 50% by volume of amorphous phase.

6. A method of preparing a wrought article from a high strength, heat resistant aluminum alloy by extrusion, press working or hot-forging at temperatures within the range of the crystallization temperature of said aluminum alloy ±100° C., said aluminum alloy having a composition represented by the general formula:

$$Al_aM_bQ_cX_e$$

wherein:

M is at least one metal element selected from the group consisting of Cu, Ni, Co and Fe;

Q is at least one metal element selected from the group consisting of Mn, Cr, Mo, W, Ti and Zr;

X is at least one metal element selected from the group consisting of Nb, Ta, Hf and Y; and a, b, c and e are atomic percentages falling within the following ranges: $45 \leqq a \leqq 90$, $5 \leqq b \leqq 40$, $0 < c \leqq 12$, and $0.5 \leqq e \leqq 10$, said aluminum alloy containing at least 50% by volume of amorphous phase.

* * * * *